US007316124B2

(12) United States Patent
Lee

(10) Patent No.: US 7,316,124 B2
(45) Date of Patent: Jan. 8, 2008

(54) DISPENSER ASSEMBLY IN REFRIGERATOR AND REFRIGERATOR THEREWITH

(75) Inventor: Chang Lim Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 235 days.

(21) Appl. No.: 10/824,366

(22) Filed: Apr. 15, 2004

(65) Prior Publication Data

US 2004/0206106 A1 Oct. 21, 2004

(30) Foreign Application Priority Data

Apr. 17, 2003 (KR) ..... 10-2003-0024212

(51) Int. Cl.
*B67D 5/62* (2006.01)
*F25D 11/00* (2006.01)

(52) U.S. Cl. ..... 62/389; 62/440; 138/110

(58) Field of Classification Search ..... 138/110; 62/72, 298, 259.1, 389, 440
See application file for complete search history.

(56) References Cited

U.S. PATENT DOCUMENTS 2,530,812 A * 11/1950 Carmer, Jr. et al. ..... 174/135
2,769,999 A * 11/1956 Sheahan ..... 15/327.2
3,853,148 A * 12/1974 De Vincent et al. ..... 138/110
3,942,528 A * 3/1976 Loeser ..... 604/174
6,167,914 B1 * 1/2001 Koteskey ..... 138/110

* cited by examiner

*Primary Examiner*—Mohammad M. Ali
(74) *Attorney, Agent, or Firm*—Birch, Stewart, Kolasch & Birch, LLP

(57) ABSTRACT

Dispenser assembly in the refrigerator having a body and a door for opening/closing a front surface of the body, including a dispenser in the front surface of the door for supplying water, a hinge coupled between the door and the body, a water supply pipe passed through insides of the hinge and the door, and connected to the dispenser, and a curved holding member above the hinge to surround and hold the water supply pipe, thereby holding the water supply pipe securely.

26 Claims, 4 Drawing Sheets

DISPENSER ASSEMBLY IN REFRIGERATOR AND REFRIGERATOR THEREWITH

This application claims the benefit of the Korean Application No. P2003-0024212 filed on Mar. 17, 2003, which is hereby incorporated by reference.

BACKGROUND OF THE INVENTION

1. Field of the Invention

The present invention relates to refrigerators, and more particularly, to a dispenser assembly in a refrigerator, for secure holding of a water supply pipe connected to a dispenser, and a refrigerator therewith.

2. Background of the Related Art

The refrigerators, supplying cold air produced from an evaporator in a refrigerating cycle for long time fresh storage of food. There are a variety of types of refrigerators commercially available for meeting various demands of consumers, such as an upright type having a freezing chamber and a refrigerating chamber arranged in up and down direction, and a standing side by side type having the freezing chamber and the refrigerating chamber arranged in left and right direction for providing larger effective inside spaces.

Moreover, recently, refrigerators each having an icemaker and a dispenser are commercially available for meeting various demands of the consumers. The icemaker is in general arranged in an upper portion of the freezing chamber for freezing water supplied from an outside of the refrigerator. The dispenser, in general mounted in a front surface of a door, so that the user is supplied with cold water without opening the door.

FIG. 1 illustrates a perspective view of a related art refrigerator.

Referring to FIG. 1, the related art refrigerator is provided with a body 1, an upper door 2 and a lower door 3 for opening/closing a front of the body, and a hinge 5 for coupling the upper door 2 to the body 1.

There are a hinge cover 6 on the hinge 5, and a dispenser 4 in a front surface of the upper door 2. The dispenser 4 is connected to a water supply pipe 7 for supplying water to the user, and the water supply pipe 7 is extended to an upper portion of the body 1 through the upper door 2 and the hinge 5.

The water supply pipe 7 is connected to a water works (not shown) directly, or through a water supply valve (not shown).

FIG. 2 illustrates a section of a related art dispenser assembly of a refrigerator.

Referring to FIG. 2, the water supply pipe 7 passes through the hinge 5 and the upper door 2, and is connected to the dispenser 4 (see FIG. 1), and there is a hinge cover 6 on the hinge 5.

The hinge cover 6 covers the water supply pipe 7 for protecting the water supply pipe 7 from an external impact. Moreover, the hinge cover 6 hides the water supply pipe for better overall outside appearance of the refrigerator.

In the meantime, the water supply pipe 7 is sharply bent as the water supply pipe 7 passes through the hinge 5 and extended to an upper portion of the body 1. This structure prevents the water supply pipe 7 from extending high above the upper portion of the body 1, to reduce a height of the hinge cover 6 that covers the water supply pipe 7, thereby preventing the height of the refrigerator from becoming high unnecessarily, and improving an overall outside appearance of the refrigerator.

However, the related art dispenser assembly of the refrigerator has the following problems.

First, as shown in FIG. 2, the sharp bending of the water supply pipe 7 liable to forms a block portion 8 in the water supply pipe 7, to block the water supply pipe 7. In this case water supply through the water supply pipe 7 is impossible, to affect quality of the refrigerator.

Second, the sharp bending of the water supply pipe 7 provides an elastic force for restoring the water supply pipe 7 to an original state, which applies a strong force to the hinge cover 6. Particularly, water supplied to the water supply pipe 7, the elastic force of the water supply pipe 7 becomes greater by a hydraulic pressure.

Consequently, if the water supply pipe 7 keeps applying a pressure to the hinge cover 6 owing to the elastic force, the hinge cover 6 is liable to break.

SUMMARY OF THE INVENTION

Accordingly, the present invention is directed to a dispenser assembly in a refrigerator, and a refrigerator therewith that substantially obviates one or more of the problems due to limitations and disadvantages of the related art.

An object of the present invention is to provide a dispenser assembly in a refrigerator, and a refrigerator therewith, which can hold a water supply pipe, securely.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the dispenser assembly in the refrigerator having a body and a door for opening/closing a front surface of the body, includes a dispenser in the front surface of the door for supplying water, a hinge coupled between the door and the body, a water supply pipe passed through insides of the hinge and the door, and connected to the dispenser, and a curved holding member above the hinge to surround and hold the water supply pipe.

The holding member preferably has an inside diameter smaller than an outside diameter of the water supply pipe.

The holding member has an opening for inserting the water supply pipe therethrough, and has holes in the other side surface for pushing out the water supply pipe inserted therein.

The holding member has projections from opposite sides of the opening at upper and lower ends of the holding member. The holding member has an inside diameter at the portion of the projections smaller than an outside diameter of the water supply pipe.

The holding member has a semi-cylindrical form having one opened side surface, and has an inside diameter smaller than an outside diameter of the water supply pipe.

The holding member has a reinforcing rib for preventing the holding member from breaking by an elastic force of the water supply pipe.

The dispenser assembly further includes recess portions in a top portion of the door and the hinge portion having the water supply pipe passed therethrough.

In other aspect of the present invention, there is provided a refrigerator including a body, a door for opening/closing a front surface of the body, a dispenser in the front surface of the door for supplying water, a hinge coupled between the door and the body, a water supply pipe passed through insides of the hinge and the door, and connected to the dispenser, a hinge cover for covering and protecting the water supply pipe, and a curved holding member above the hinge to surround and hold the water supply pipe.

The holding member preferably has an inside diameter smaller than an outside diameter of the water supply pipe.

The holding member has an opening for inserting the water supply pipe therethrough, and has holes in the other side surface for pushing out the water supply pipe inserted therein.

The holding member has projections from opposite sides of the opening at upper and lower ends of the holding member. The holding member has an inside diameter at the portion of the projections smaller than an outside diameter of the water supply pipe.

The holding member has a semi-cylindrical form having one opened side surface, and has an inside diameter smaller than an outside diameter of the water supply pipe.

The holding member has a reinforcing rib for preventing the holding member from breaking by an elastic force of the water supply pipe.

The dispenser assembly further includes recess portions in a top portion of the door and the hinge portion having the water supply pipe passed therethrough.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE PREFERRED EMBODIMENT

Figure 3:
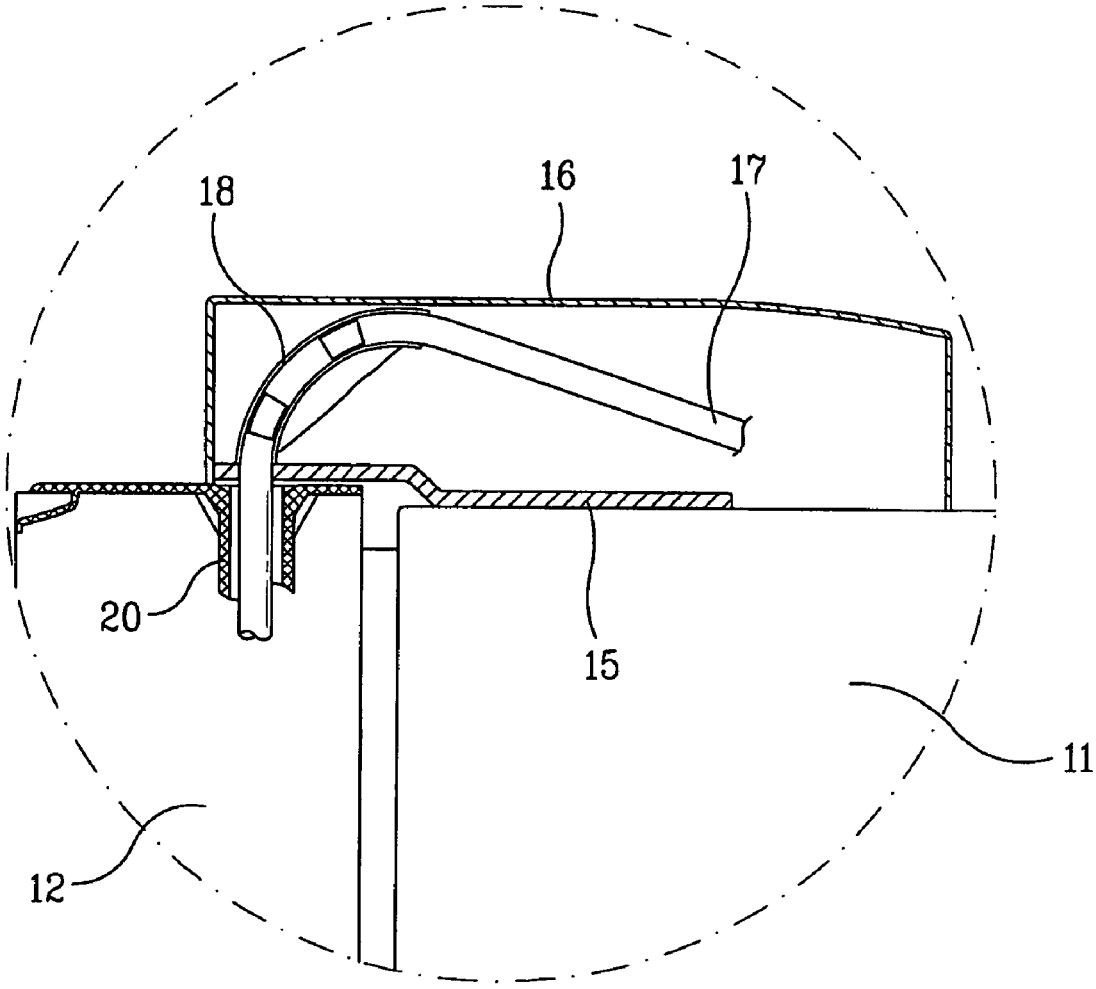
FIG. 3 illustrates a section of a dispenser assembly of a refrigerator in accordance with a first preferred embodiment of the present invention.

Reference will now be made in detail to the preferred embodiments of the present invention, examples of which are illustrated in the accompanying drawings. In describing the embodiments, identical parts will be given the same names and reference symbols, and repetitive description of which will be omitted. FIG. 3 illustrates a section of a dispenser assembly of a refrigerator in accordance with a first preferred embodiment of the present invention.

Referring to FIG. 3, the refrigerator of the present invention includes a body 11, a door 12, and a dispenser assembly of the refrigerator.

The body 11 forms an outside appearance of the refrigerator, and opens/closes a front surface of the body 11. The dispenser assembly in the refrigerator supplies water to a user directly.

The dispenser assembly in the refrigerator will be described in more detail.

The dispenser assembly of the refrigerator includes a dispenser (not shown) in a front surface of the door 11, for supplying water, a hinge 15 for coupling the body 11 to the door 12, a water supply pipe 17, and a holding member 18.

The hinge 15, on top of the body 11 and the door 12, enables the door 12 to rotate to open/close the front surface of the body 11.

The water supply pipe 17 passes insides of the hinge 15 and door 12, and is connected to the dispenser. The door 12 has a water supply pipe passage 20 for guiding the water supply pipe 17 to a portion the dispenser is located. There is a hinge cover 16 above the water supply pipe 17, for protecting the water supply pipe 17 from an external impact.

The holding member 18 is above the hinge 15 for surrounding and holding the water supply pipe 17. The holding member 18 has curve form to make the water supply pipe 17 bent moderately.

Figure 1:
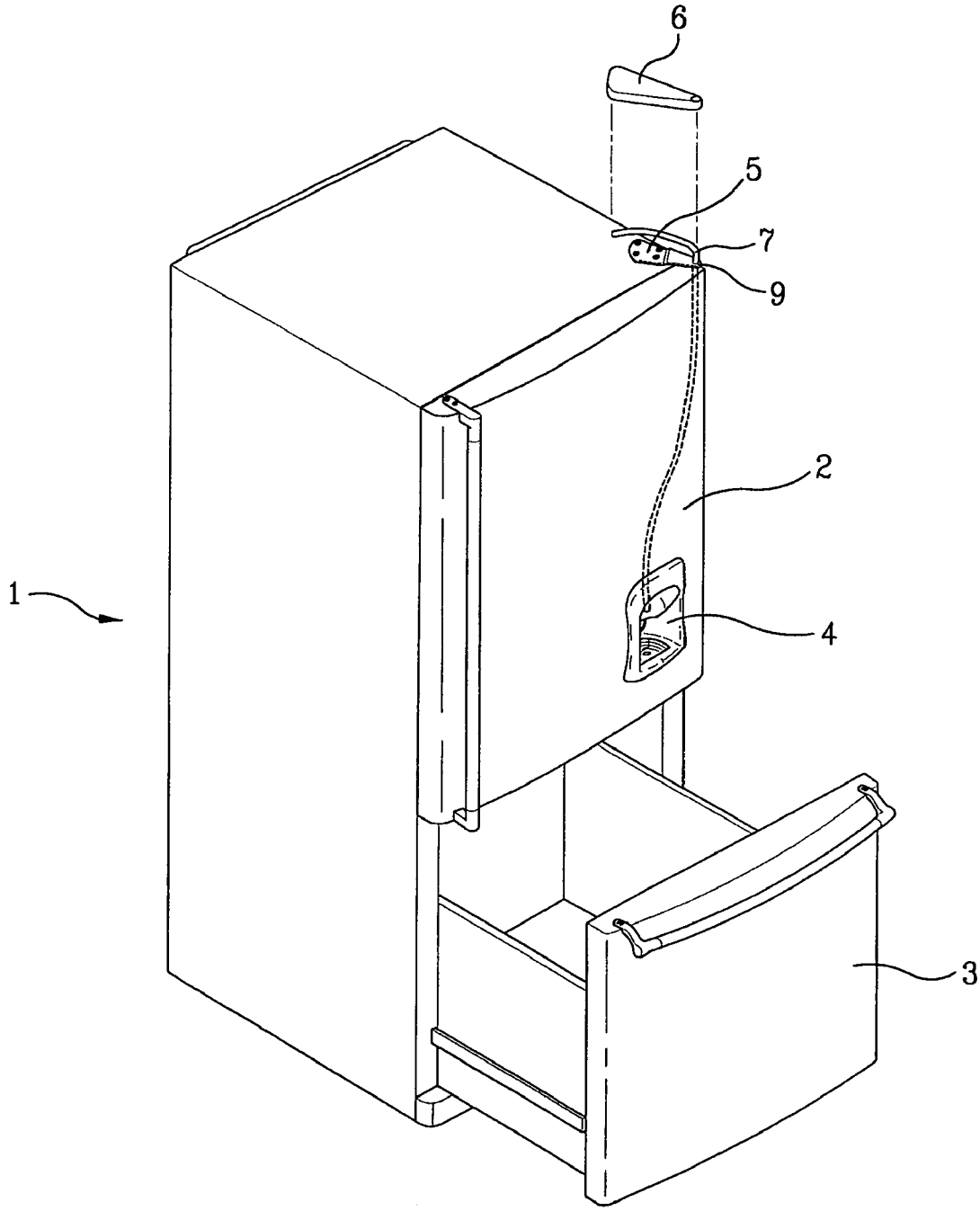
FIG. 1 Prior Art
FIG. 1 illustrates a perspective view of a related art refrigerator.
Figure 2:
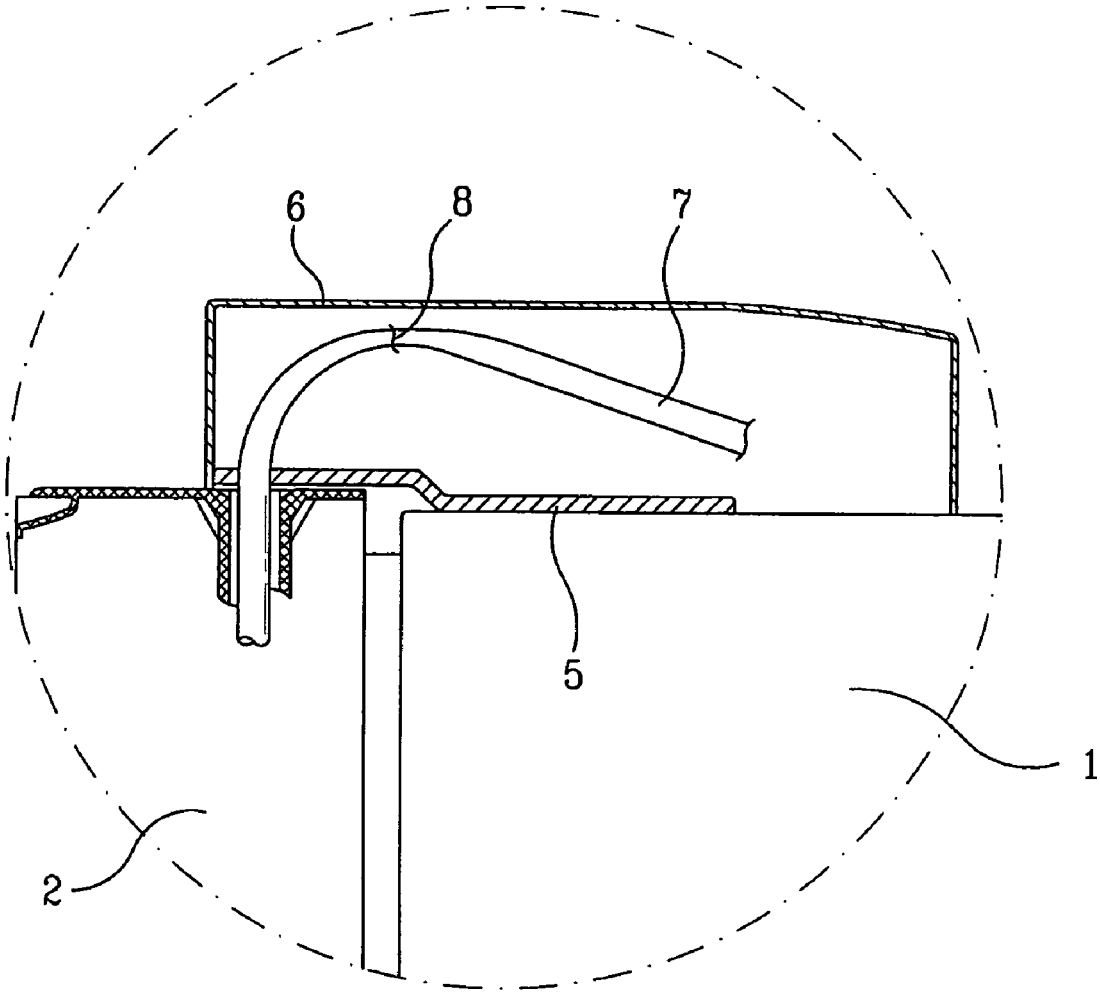
FIG. 2 Prior Art
FIG. 2 illustrates a section of a related art dispenser assembly of a refrigerator.

According to this, the water supply pipe 17 is bent moderately by the holding member 18, to prevent the block portion (see FIG. 2) from being formed as the water supply pipe 17 is bent sharply like the related art.

In the meantime, it is preferable that an inside diameter of the holding member is smaller than an outside diameter of the water supply pipe 17. In this case, the water supply pipe 17 is tightly held inside of the holding member 18, and prevented from breaking away from the holding member 18 by an external impact.

Figure 4:
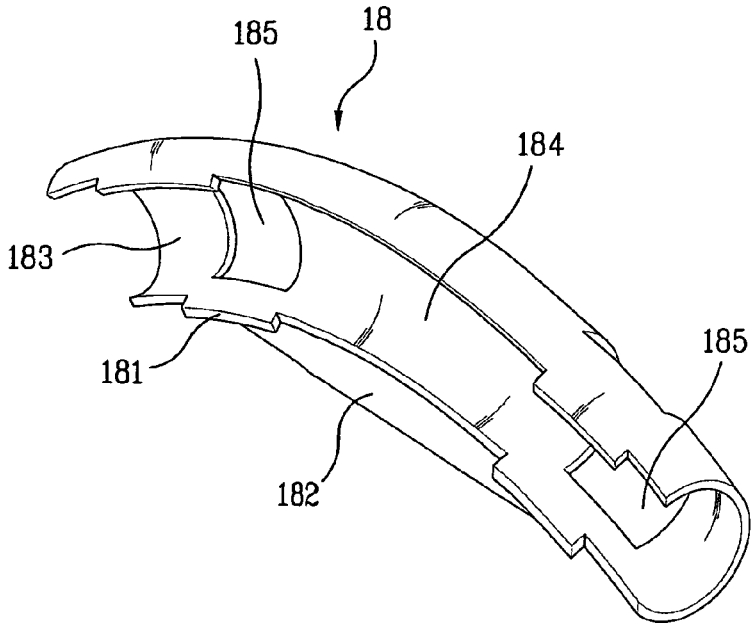
FIG. 4 illustrates a perspective view of a holding member in accordance with a preferred embodiment of the present invention.

FIG. 4 illustrates a perspective view of the holding member of the present invention.

Referring to FIG. 4, the holding member 18 has an opening 184 in one side for inserting the water supply pipe 17. The opening 184 is extended along a length direction of the holding member 18. Therefore, it is handy to insert the water supply pipe 17 into an inside of the holding member 18 through the opening 184.

The holding member 18 has a semi-cylindrical form having one opened side. The inside diameter of the holding member 18 may be smaller than an outside diameter of the water supply pipe 17.

Moreover, the holding member 18 has holes 185 in the other side surface for pushing out the water supply pipe 17 inserted therein.

In more detail, the holes 185, in a portion opposite to the opening 184, enables handy removal of the water supply pipe 17 from the holding member 18. It is preferable that the holes 185 are formed in opposite ends of the holding member 18, respectively. When the user intends to remove the water supply pipe 17 from the holding member 18, the user inserts fingers into the holes 185, and pushes away the holding member 18.

Of course, a number and positions of the holes 185 may vary with a mold for fabricating the holding member 18.

In the meantime, the holding member 184 has projections 181 from opposite sides of the opening 184 at upper and lower ends of the holding member 184, for preventing the water supply pipe 17 from breaking away from the holding member 18. The projections 181 prevent the water supply pipe 17 inserted in the holding member from breaking away through the opening 184.

That is, it is liable that the water supply pipe 17 escapes through the opening 184 if an external impact is applied to the water supply pipe 17, because a side surface of the holding member 18 having the opening 184 formed therein is opened. Once the projections 181 are formed, the water supply pipe 17 is caught at the projections 181, to prevent easy escape therefrom.

Moreover, it is preferable that the holding member 18 has an inside diameter smaller than an outside diameter of the water supply pipe 17 in portions having the projections 181 formed thereon. In this instance, the water supply pipe 17 inserted in the holding member 18 is held tightly only at opposite ends by the projections 181.

According to this, the water supply pipe 17 can be inserted into an inside of the holding member 18 with a smaller force compared to a case when an entire inside diameter of the holding member 18 is formed smaller than an outside diameter of the water supply pipe 17.

Of course, there can be many variations, such as the inside diameter of the holding member 18 becomes the smaller as it goes from a center to the opposite ends the farther.

In the meantime, the holding member 18 has a reinforcing rib 182 for preventing the holding member 18 from being broken by an elastic force of the water supply pipe 17.

In more detail, the water supply pipe 17, in general formed of an elastic material, has an elastic force intending to restore to an original state once the water supply pipe 17 is inserted in the holding member 18 in a bent state. Moreover, when water is supplied to the water supply pipe 17, the elastic force that the water supply pipe 17 intends to restore to an original state becomes stronger by a water pressure.

Therefore, since the holding member 18 is liable to break if the elastic force is applied to the holding member 18 for a long time, the reinforcing member 182 is formed at the holding member 18, so that the holding member 18 endures the elastic force of the water supply pipe 17.

Figure 5:
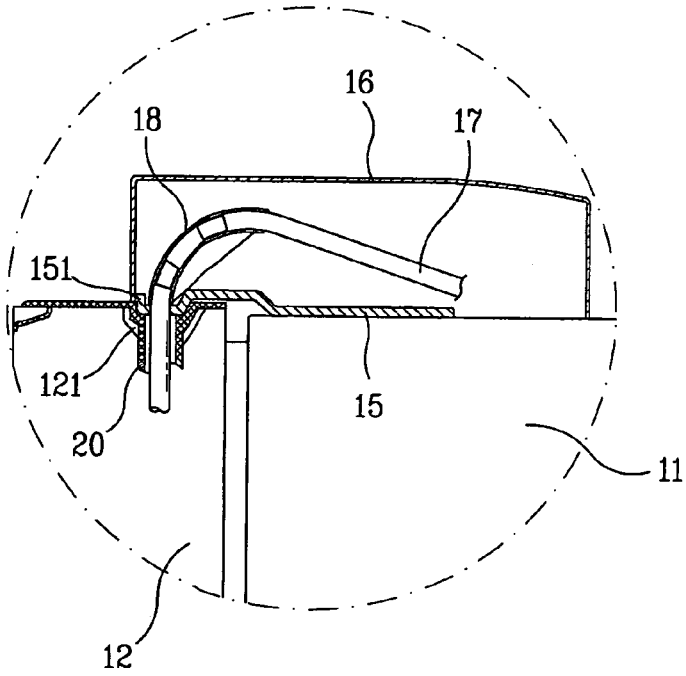
FIG. 5 illustrates a section of a dispenser assembly of a refrigerator in accordance with a second preferred embodiment of the present invention.

FIG. 5 illustrates a section of a dispenser assembly of a refrigerator in accordance with a second preferred embodiment of the present invention.

Referring to FIG. 5, the embodiment of the present invention includes recess portions 121, and 151 in an upper portion of the door 12 and a hinge 15 portion having the water supply pipe 17 passed therethrough.

In more detail, the recess portions 121, and 152 include a door recess portion 121 having a recess formed to downward of the door 12, and a hinge recess portion 151 in the hinge 15.

The recess portions 121, and 151 enable to lower a position of the holding member 18 provided to a top portion of the hinge 15. This means that the bending portion of the water supply pipe 17 moves downward. According to this, a height of the water supply pipe 17 extended up from the refrigerator is lowered, enabling to lower entire height of the refrigerator.

As has been described, the dispenser assembly in a refrigerator of the present invention has the following advantages.

First, the formation of the block portion caused by bending of the water supply pipe is prevented, thereby permitting smooth supply of water from the dispenser.

Second, the rigid holding of the water supply pipe by the holding member can prevent damage to the hinge cover caused by an elastic force generated when the water supply pipe is bent, or water is supplied to the water supply pipe.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A dispenser assembly for a refrigerator having a body and a door for opening/closing a front surface of the body, comprising:

a dispenser in a front surface of the door for supplying water;

a hinge coupled between the door and the body;

a water supply pipe passed through insides of the hinge and the door, and connected to the dispenser; and a curved holding member above the hinge that partially surrounds and holds the water supply pipe, wherein the holding member has projections from opposite sides of the opening at upper and lower ends of the holding member.

2. The dispenser assembly as claimed in claim 1, wherein the holding member has an inside diameter smaller than an outside diameter of the water supply pipe.

3. The dispenser assembly as claimed in claim 1, wherein the holding member has an inside diameter at the portion of the projections smaller than an outside diameter of the water supply pipe.

4. The dispenser assembly as claimed in claim 1, wherein the holding member has a semi-cylindrical form having one opened side surface.

5. The dispenser assembly as claimed in claim 4, wherein the holding member has an inside diameter smaller than an outside diameter of the water supply pipe.

6. The dispenser assembly as claimed in claim 1, wherein the holding member has a reinforcing rib for preventing the holding member from breaking by an elastic force of the water supply pipe.

7. The dispenser assembly as claimed in claim 1, wherein the curved holding member includes an opening on a side of the holding member for inserting the water supply pipe therethrough, the opening extending along a length of said curved holding member and lying within a substantially flat plane.

8. A dispenser assembly for a refrigerator having a body and a door for opening/closing a front surface of the body, comprising:

a dispenser in a front surface of the door for supplying water;

a hinge coupled between the door and the body;

a water supply pipe passed through insides of the hinge and the door, and connected to the dispenser; and a curved holding member above the hinge that partially surrounds and holds the water supply pipe, wherein the holding member has holes in the other side surface, the holes being sized to allow the water supply pipe to be pushed out from the holding member.

9. A dispenser assembly for a refrigerator having a body and a door for opening/closing a front surface of the body, comprising:

a dispenser in a front surface of the door for supplying water;

a hinge coupled between the door and the body;

a water supply pipe passed through insides of the hinge and the door, and connected to the dispenser;

a curved holding member above the hinge that partially surrounds and holds the water supply pipe; and recess portions in a top portion of the door and the hinge portion having the water supply pipe passed therethrough.

10. A refrigerator comprising:

a body;

a door for opening/closing a front surface of the body;

a dispenser in a front surface of the door for supplying water;

a hinge coupled between the door and the body;

a water supply pipe passed through insides of the hinge and the door, and connected to the dispenser;

a hinge cover for covering and protecting the water supply pipe;

a curved holding member above the hinge that partially surrounds and holds the water supply pipe; and recess portions in a top portion of the door and the hinge portion having the water supply pipe passed therethrough.

11. The refrigerator as claimed in claim 10, wherein the holding member has an inside diameter smaller than an outside diameter of the water supply pipe.

12. The refrigerator as claimed in claim 10, wherein the holding member has a semi-cylindrical form having one opened side surface.

13. The refrigerator as claimed in claim 12, wherein the holding member has an inside diameter smaller than an outside diameter of the water supply pipe.

14. The refrigerator as claimed in claim 10, wherein the holding member has a reinforcing rib for preventing the holding member from breaking by an elastic force of the water supply pipe.

15. The refrigerator as claimed in claim 10, wherein the curved holding member includes an opening on a side of the holding member for inserting the water supply pipe therethrough, the opening extending along a length of said curved holding member and lying within a substantially flat plane.

16. A refrigerator comprising:

a body;

a door for opening/closing a front surface of the body;

a dispenser in a front surface of the door for supplying water;

a hinge coupled between the door and the body;

a water supply pipe passed through insides of the hinge and the door, and connected to the dispenser;

a hinge cover for covering and protecting the water supply pipe;

a curved holding member above the hinge that partially surrounds and holds the water supply pipe, wherein the holding member has holes in the other side surface, the holes being sized to allow the water supply pipe to be pushed out from the holding member.

17. A refrigerator comprising:

a body;

a door for opening/closing a front surface of the body;

a dispenser in a front surface of the door for supplying water;

a hinge coupled between the door and the body;

a water supply pipe passed through insides of the hinge and the door, and connected to the dispenser;

a hinge cover for covering and protecting the water supply pipe;

a curved holding member above the hinge that partially surrounds and holds the water supply pipe, wherein the holding member has projections from opposite sides of the opening at upper and lower ends of the holding member.

18. The refrigerator as claimed in claim 17, wherein the holding member has an inside diameter at the portion of the projections smaller than an outside diameter of the water supply pipe.

19. A dispenser assembly for a refrigerator having a body and a door for opening/closing a front surface of the body, comprising:

a dispenser in a front surface of the door for supplying water;

a hinge coupled between the door and the body;

a water supply pipe passed through insides of the hinge and the door, and connected to the dispenser; and a curved holding member above the hinge to surround and hold the water supply pipe, wherein the holding member has a reinforcing rib for preventing the holding member from breaking by an elastic force of the water supply pipe.

20. A refrigerator comprising:

a body;

a door for opening/closing a front surface of the body;

a dispenser in a front surface of the door for supplying water;

a hinge coupled between the door and the body;

a water supply pipe passed through insides of the hinge and the door, and connected to the dispenser;

a hinge cover for covering and protecting the water supply pipe; and a curved holding member above the hinge to surround and hold the water supply pipe, wherein the holding member has a reinforcing rib for preventing the holding member from breaking by an elastic force of the water supply pipe.

21. A support for a flexible tube, comprising:

a holding member having a first end portion and a second end portion;

a curved innermost wall extending between said first end portion and said second end portion;

a first holding portion proximate said first end portion, said first holding portion including a first tube receiving opening, said first holding portion configured to partially surround a flexible tube received therein;

a second holding portion proximate said second end portion, said second holding portion including a second tube receiving opening, said second holding portion configured to partially surround a flexible tube received therein, wherein said first tube receiving opening and said second tube receiving opening are lying within a substantially flat plane; and a reinforcing rib member located adjacent to said innermost wall and extending between said first holding portion and said second holding portion.

22. The support according to claim 21, further comprising a curved outermost wall interconnecting said first holding portion and said second holding portion.

23. The support according to claim 22, wherein said first holding portion and said second holding portion are interconnected such that said first tube receiving opening adjoins said second tube receiving opening to form a curved tube receiving slot.

24. The support according to claim 22, wherein said innermost wall and said outermost wall each include a curved inner wall surface and a curved outer wall surface.

25. A support for a flexible tube, comprising:

a holding member having a first end portion and a second end portion;

a curved innermost wall extending between said first end portion and said second end portion;

a first holding portion proximate said first end portion, said first holding portion including a first tube receiving opening, said first holding portion configured to partially surround a flexible tube received therein;

a second holding portion proximate said second end portion, said second holding portion including a second tube receiving opening, said second holding portion configured to partially surround a flexible tube received therein, wherein said first tube receiving opening and said second tube receiving opening are lying within a substantially flat plane, wherein said first holding portion and said second holding portion each include a pair of projections extending toward one another from said innermost wall and said outermost wall.

26. A support for a flexible tube, comprising:

a holding member having a first end portion and a second end portion;

a curved innermost wall extending between said first end portion and said second end portion;

a first holding portion proximate said first end portion, said first holding portion including a first tube receiving opening, said first holding portion configured to partially surround a flexible tube received therein;

a second holding portion proximate said second end portion, said second holding portion including a second tube receiving opening, said second holding portion configured to partially surround a flexible tube received therein, wherein said first tube receiving opening and said second tube receiving opening are lying within a substantially flat plane, wherein the holding member has holes in a side surface, the holes being sized to allow the flexible tube to be pushed out from the holding member.

* * * * *